United States Patent [19]

Tsukumo

[11] 4,015,797

[45] Apr. 5, 1977

[54] BOBBIN HANGER

[75] Inventor: Zenzaburo Tsukumo, Nishinomiya, Japan

[73] Assignee: NTN Toyo Bearing Company Ltd., Osaka, Japan

[22] Filed: Nov. 6, 1975

[21] Appl. No.: 629,583

[30] Foreign Application Priority Data

Nov. 9, 1974 Japan ..... 49-129299

[52] U.S. Cl. ..... 242/130.2; 242/129.7

[51] Int. Cl.[2] ..... B65H 49/00; B65H 49/02; D03J 5/08

[58] Field of Search ..... 242/129.5, 129.7, 130.2, 242/136

[56] References Cited

UNITED STATES PATENTS 3,877,659 4/1975 Takata ..... 242/130.2

*Primary Examiner*—Leonard D. Christian
*Attorney, Agent, or Firm*—Hall & Houghton

[57] ABSTRACT

A bobbin hanger provided with self-aligning means comprising an upper member of the joint type fixed to or swingably suspended from a hanger rail, a lower member having engageable members in the form of horizontally and radially disposed balls engageable with the top bore shoulder of a bobbin, and an intermediate member of the pivot type disposed between the upper and lower members and adapted to perform a self-aligning function, said bobbin hanger being designed and assembled in such a manner as to establish a free joint condition and a centripetal condition and provide the necessary particular braking force.

5 Claims, 21 Drawing Figures

BOBBIN HANGER

OUTLINE OF THE INVENTION

1. Field of the Invention

The present invention relates to a bobbin hanger for use with the creel of a textile machine, particularly a spinning or roving frame, said bobbin hanger being adapted to suspend a bobbin of the type generally referred to as the roving bobbin, which is formed with a step portion at the shoulder of the central bore of the bobbin.

2. Description of the Prior Art

Bobbin hangers of this type used with the creel of a textile machine, particularly a spinning or roving frame are employed for suspending a bobbing of the type generally referred to as the roving bobbin, which is formed with a step portion at the inner shoulder of the central bore of the bobbin. Generally, the bobbin support systems may be divided into two types, namely, a system using a skewer and a so-called skewerless attachment system similar thereto but omitting the intermediate portion thereof. In these systems, the lower pointed end of the bobbin insertion skewer is surface-supported or point-supported in a pivot fashion by a support cup or such support cups directly carrying a bobbin thereon are surfacesupported or point-supported in a pivot fashion, decreasing the torque friction resistance, and by braking in a fixed range essentially by the upper support, the rotation of the bobbin is made light and smooth. These types, however, do not match with the modern textile operation procedures and, more particularly, prolonged use will result in cotton waste accumulating on the support, or possible damage to the pointed end of the skewer will induce an irregular excessive resistance to the rotation of the skewer or bobbin support surface, bringing about changes in the withdrawing tension in the roving, which, in turn, form a cause of unevenness and breakage of yarn. More importantly, in recent years there is a trend toward a large package, which necessitates changing the creel arrangement itself such that the bottom support cup system is made unusable. For this reason, in recent years there is an increasing market need for a bobbin hanger which, in order to facilitate and rationalize the creel design and bobbin handling and to secure high quality, is designed so that it rotatably suspends a bobbin in place of said conventional support systems and is easy to handle and provides a reliable, smooth and stable rotation. Thus, the conventional commercially available suspension type bobbin hanger is constituted essentially by two bodies, namely, an upper member and a lower member, but the manner in which the upper and lower members engage each other and the manner in which the lower member engages the bobbin have inherent disadvantages from the standpoint of efficiency and operation. They have been a serious bottleneck in producing a yarn of good quality in a stable manner for a long time. Generally, in order to facilitate the donning and doffing of bobbins it is necessary to suspend the bobbin hanger in such a manner as to be rotatable and swingable in all directions with respect to a hanger rail horizontally secured to the creel. Further, the suspendable bobbin is inserted and removed from the lower end of the bobbin hanger. In this connection, it is usual with the bobbin to be attached in an inclined condition. Therefore, it is desirable that as soon as the bobbin is released, it will damp its swing and will be selfaligned and restored to its normal position and rest by itself. To this end, a combined construction is most effective in which a universal joint is used in the interior of the hanger and self-aligning balls are used in the lower portion. Further, in bobbin hangers of the conventional type, a thrust bearing which uses bearing balls is commonly used in the connecting portion and it forms a rotary bearing portion which is the most important functional portion of the bobbin hanger. As described above, in a functional aspect, the bobbin hanger is required to quickly damp its pendulum motion and assume its normal position. If the hanger is too easily rotatable, external forces (exerted, for example, by machine frame vibration, a blow cleaner, etc.) during the operation or the efforts of the sliver cause the hanger to be excessively rotated easily and inertially or to be intermitently rotated, with stoppage alternating with rotation, resulting in nonuniformity of tension in the sliver being withdrawn, producing an incorrect and irregulaar draft phenomenon which forms a cause of uneven yarn and which, in an extreme case, induces the spontaneous unwinding of the roving or, in the contrary, causes roving breakage on the creel side. Further, since the conventional bobbin hanger is constructed so that the bearing portion is exposed to the ambient atmosphere, dewing tends to occur in the interior of the bearing, resulting in rusting and cotton waste tends to enter said bearing and firmly adhere thereto. As a result, various drawbacks are caused, detracting from the bearing performance and greatly affecting the quality of yarn, such instances being too numerous to mention.

A conventional bobbin hanger, is constructed so that the entire bobbin hanger including a bobbin is integral and suspended from the lower side of a hanger rail by means of a universal joint which also serves as a bearing disposed at the upper end of the bobbin hanger. As a result, if the hanger swings, the whole swings as a single pendulum. If the entire length of the hanger (including the length of the bobbin) is represented by 1, then the period T is as follows.

$$T = 2\sqrt{1/g}.$$

That is, the period T of a pendulum is proportional to the root of the hanger length 1. The greater the period T, the longer the time taken for the oscillation to terminate. For this reason, with the conventional bobbin hanger its oscillation, once started, will not readily terminate. Further, in the conventional bobbin hanger, the system for attaching the hanger to the hanger rail is such that a portion of the bearing is attached directly to the hanger rail, as described above. Thus, the pivot portion is not necessarily set vertical and during the operation of the bobbin, it is subjected directly to a severe percussive external force in its tilted condition. Since the bearing portion is not in sealed condition in terms of heat transmission, it is affected directly by changes in temperature and humidity in the room, and because of the position of the hanger rail and the temperature distribution in the room, there is the danger of the bearing portion reaching the dew point and eventually becoming dewy. Further, since it is in unsealed condition with respect to the ambient atmosphere, upon donning or doffing of the bobbin, air currents are produced inside the bobbin hanger due to a pumping action or a similar action and such air currents coupled with said formation of dewdrops result in the fly entering the bearing to accumulate on the bearing races and balls and eventually the bearing is rusted. In less than one year after the start of use of new bobbin hangers, the torque of the bobbins is considerably increased and widely varied among the hangers, greatly detracting from the quality and causing frequent troubles to the operation, which is no uncommon occurrence. In this connection, it has been demonstrated that this influence is a major factor contributing to detraction from yarn quality and yarn breakage (there is an actual example in which the rate of contribution is 25%). Further, the construction of the conventional bobbin hanger is such that the bobbin is fitted over the rotatable portion whereupon a pair of locking members folded inside the rotatable portion are laterally spread or projected in opposite directions to abut against the shoulder portion of the bobbin and that when the bobbin is to be removed from the bobbin hanger, the projecting locking members are automatically folded back into the rotatable portion in conjunction with the effort to detach the bobbin from the rotatable portion. Conventionally, since this type of bobbin hanger is suspended by means of two locking members, the bobbin is supported at two points. As a result, the support of the suspended bobbin is unstabale and the centerline of the hanger will not become aligned with the centerline of the bobbin, forming a cause of making the rotation of the bobbin non-smooth and producing eccentric rotation or precessional movement of the bobbin, so that the tension in the roving becomes uneven or the inner surface of the suspending portion of the hanger is damaged, thereby promoting this drawback. For this reason, unevenness of yarn and breakage of roving occur.

Undesirable incorrect draft which can occur in unwinding a package of roving becomes a major cause of unevenness of yarn count and is in correlation with breakage of roving and yarn. Generally, incorrect draft is dependent on the quality of a package of roving itself, but in many cases, it is materially affected by the rotative performance (withdrawing torque) of a bobbin hanger which supports the package of roving for rotation at the creel of a spinning frame. There are many cases in which the main cause of the occurrence of unevenness of yarn, when checked in the field, is found to be a bobbin hanger. The evaluation of the quality of yarn in recent markets is very minute, and particularly in the field of knttting yarn and high-class shirt yarn, it has begun to be emphasized that the quality of yarn has a serious effect not only on the quality of the product but also on productivity. The increase in the weight of the package due to the recent trend toward large packages is enormous and the package today weighs more than 3 Kg as contrasted to the conventional package 1 Kg. Thus, any one of the increases in the weight, diameter and lift is an unfavorable factor tending to induce irregular draft, which accounts for the urgent need for an improved bobbin support device.

First of all, mention may be made of the skewer system. This system, which has heretofore been widely used, belongs to the so-called pivot system, consisting of a very simple mechanism which, comprises a combination of concave and convex forms opposed to each other.

In such a system, a bobbin and a skewer are provided with the bottom of the skewer contacting a support cup in a pivot fashion, while the top of the skewer contacts the inner surface of a top collar so as to have a light braking force applied thereto. The above-mentioned two functions cooperate with each other to maintain smooth unwinding of a package of roving with good balance. The features of this system include the following. First, the system is capable of holding down the scattering of the unwinding tension to the minimum without necessitating high precision in the parts, and it has high stability without having to be serviced for a long time. Secondly, it has a high degree of adaptability to the fly and dust and since the parts are made of boxwood and porcelain, respectively, it has a low coefficient of friction and suffers little trouble as a dry bearing. Thirdly, it is almost immune from the influence of temperature and humidity. Fourthly, Even if damage or separation occurs to the system, anyone can repair the same with ease. This system has a record of more than 200 years in use and was an excellent system. Starting from the time about 10-odd years ago when the double roving system aiming at improving the quality was popular, high interest was centered in the creel of the spinning frame, developing into the creation of the following two systems.

One of them is the skewerless attachment system, which comprises a combination of a set of upper and lower attachments and an itermediate portion which is a bobbin itself, constituting a rotatable support. In principle, it is no different from the first, skewer system. This system has become widely used as backed up by the advance of plastics, coupled with its simple construction and stable performance.

The other is the bobbin holder system. This system made its advent along with the advance of large packages. By reason of the fact that the support part which supports the lower portion of the package form an obstacle to the operation, the hanger type holder by which the package is supported only at its upper portion has become widely used. It has been generally accepted that the use of a bobbin hanger simplifies the creel of the spinning frame and greatly facilitates the operation. This system, however, has two drawbacks in its performance. One drawback is a trouble caused by the use of a ball bearing in the rotation support portion. The other is a problem of brake. Both are connected with the decisive function of the bobbin hanger and lead to a fatal problem. There are several types of bobbin hangers which are in use today, but they are substantially the same in construction, represented by the umbrella syste. FIG. 4 shows the consstruction of a rotatable part or thrust bearing 9 utilizing a ball bearing used in this system. In this system, the bearing support portion seems to be sealed at a glance. Actually, however, it is in intimate contact with the ambient atmosphere and it is in such a condition that it is unstably exposed. It has been demonstrated in the field that for lack of due consideration in design this system has factors leading to the occurrence of troubles such as wear of and damage to the important parts. As for the brake, there are various systems including one rubbing the exterior of the package and another which acts to brake inside the hanger, but they are unsatisfactory particularly in that there is a lack in the correcting force for the braking force due to changes in the diameter of the package.

SUMMARY OF THE INVENTION

The present invention relates to a bobbin hanger provided with automatic centripetal means and more particularly it relates to a bobbin hanger provided with automatic centripetal means, comprising an upper member, a lower member and an intermediate member, said intermediate member being a centripetal member having a bar-like body of the pivot type provided with spherical surfaces at opposite ends thereof, wherein the engageable portion of said upper member of the universal joint type cooperating with said centripetal member and the engageable portion of said lower member of the same type having bobbin engaging members in the form of radially disposed balls are, for example, inwardly inclined in order to maintain a clearance for self alignment at the opposed surface of the bar-like body of the centripetal member and are bowl-shaped to make line- or surface-contact in the contact region with the bulge, and these three members are designed and assembled in such a manner as to establish a free joint condition and a centripetal condition and provide an automatic braking force in the necessary particular range.

FEATURES OF THE INVENTION

Since upper and lower members E and F constituting the bobbin hanger B are interconnected by a bar-like intermediate member G and are adapted to be bendable at the respective connections, even if the bobbin hanger is swung by external forces, principally the upper member E alone executes an interference oscillation in the manner of a pendulum while the lower member F only slightly deflects to and fro in a nearly vertical condition. Further, since the upper member E has a short length 1', the period of the oscillation is short, and the weight of a bobbin A' and locking member H rollably installed in the movable portion of the lower member interfere with the upper member to effect extremely quick damping whereby the bobbin hanger B including the bobbin quickly returns to its normal position in a vertical line. Therefore, yarn breakage and incorrect draft can be excluded.

Further, according to the invention, since the lower member F is suspended from the upper member E through the intermediate member G in such a manner that it is somewhat restrained at the central region from rotation but is freely swingable, there is no possibility that the lower member F having the bobbin A mounted thereon is excessively rotated by the withdrawal of the roving during operation. Thus the withdrawing torque becomes a predetermined one and is maintained in the best condition, while the roving being withdrawn is always under an approximately constant tension.

Moreover, such is uniformly effected at each unit. Further, even if the bobbin hanger is swung by external forces, the oscillation of the lower member is minimum.

Further, according to the invention, since an annular member I adapted to close the space between the upper and lower members E and F is provided at the joint portion between the upper and lower members, there is no possibility of cotton dust entering the joint portion to adhere thereto and entry of air is also prevented. As a result, it is little influenced by temperature differences and there is no possibilty of dew-drops forming on the bearing portions. Therefore, it is possible to exclude the formation of rust, the adhesion of cotton fly and dirt and dust or the occurrence of other phenomena at said portion which can form the main cause of troubles.

Further, according to the invention, since the bobbin is supported at three points by the locking members H, the condition in which it is attached to the lower member F and particularly to the movable member J is extremely stabilized. Moreover, the alignment between the center lines of the hanger and bobbin assures that the bobbin rotates always smoothly without involving eccentric rotation or other incorrect rotation during withdrawal of roving, thereby completely excluding unevenness of yarn and breakage of roving.

Particularly in the case of using rotatable spherical members, it has been experimentally ascertained that the following marked characteristics are obtained.

If there occurs a condition in which the forces acting on the three shperical locking members in the bobbin suspending portion of the lower member are unbalanced, then the spherical bodies are caused to be rotated around their own axes and immediately displaced until they resume the perfect balanced condition, when they stop quickly.

The resistance to such rotation exerted during this process is so low that the self-alignment is sensitive and takes place accurately and quickly. Further, since steel balls for bearing use can be utilized as the spherical members, the durability is very high, to say nothing of the accuracy of operation, and they are very strong, free from deformation and damage. Thus, there is obtained an article of high order which cannot be compared to the conventional article in respect of accuracy, maintenance, stability of performance and dependability for safety.

Further, the present invention assures that the above-mentioned various conditions are fully satisfied even for the recent marked inerease in the size of packages and for the recent severe operating conditions. Further, there is no possibility that the entire suspension system which is required to maintain the accuracy of the bobbin is damaged. Further, the three-point portion in the movable portion has also a bearing capability, assuring smooth rotation, and will exert marked characteristics in some applications.

Further, the invention, in a constructional aspect thereof, uses a simple combination wherein the lower peripheral surface of the movable portion G of the lower member H is provided with window portions and locking members are simply placed in the interior; among other things, it makes full use of a self-aligning property through an unsophisticated application of the law of gravitation of the earth. As a result of this arrangement, the concept of the present invention can be easily applied to the conventional bobbin hangers of this type, and bobbin hangers will be obtained which are simple in construction, to which it is easy to impart the required accuracy, over which the amount of scatter in manufacture can be reduced to the minimum, which are suitable for mass production and which are easy to handle.

According to the invention, the thrust bearing portion is constructed as a plain bearing comprising a pivot core body consisting of a bar portion and end bulges, a bearing member (inner body) and a case (outer body) or a case-and-bearing member, wherein the edge contact surface in the contact region of the plain bearing is utilized to provide a predetermined braking force. As a result of this arrangement, the withdrawing tension in the roving becomes independent of the diameter of package within the practical required range. That is, an increase in the withdrawing moment concomitant with a change in the size of the package can be automatically controlled in such a manner that it is canceled by a decrease in the friction moment due to a decrease in the mass of the package itself. Further, the brake device essential to the conventional bobbin hanger is no longer necessary. As is clear from Coulomb's law, some wear of the bearing portion does not become a factor which varies the withdrawing tension and such wear does not proceed because of the plain bearing. Further, as a characteristic of the plain bearing, it has high stability against pressure and some impact. Since the bobbin hanger is used in an environment where the humidity is high (70–80%), it is necessary that the bearing and the pivot be protected against rusting. To this end, plastics materials are chiefly used for the plain bearing, so that particles of air and water act as a medium to spontaneously present a bearing phenomenon resembling boundary friction. As a result, an oil-less selflubricating bearing function can be easily achieved in which the frictional resistance torque is fixed and no abraded powder or rust is produced, thus ensuring a smooth continued sliding movement. Therefore, the lubrication problem can be automatically solved. Further, the thrust bearing portion in the bobbin hanger for suspending and rotatably supporting a bobbin is made in the form of a pivot, wherein the bearing member supporting the pivot is longitudinally split into two which are then put together to form an inner member, which is received in an outer member, thereby forming a pivot bearing portion. As a result of this construction, the configurations of the pivot can be freely designed without being restricted by assembly, etc. Particularly, the pivot track contact surface has high dimensional and configurational accuracy and can be easily formed. The assembly is simple and can be accurately and quickly carried out. Therefore, automatic assembly becomes easy. Further, in the present invention, since the abutting surface of the split pivot bearing is partially cut away to eliminate the influence of casting fins, no special finish is required after molding. Further, the parts are easy to produce and fit for massproduction. The productivity is high with no waste of marterial. Further, the configurations of the pivot can be optionally selected and there will be no problem even if it is more or less complicated. Further, the production of the metal mold is easy. Further, in making the thrust bearing portion in the form of a pivot bearing and combining the pivot and bearing portion, the two are formed of a strong material having low friction and abrasion factors, such as Delrin, nylon 66, Teflon, GL and other plastics materials, porcelain and titanium type materials. Therefore, there can be easily obtained a plain pivot bearing which is highly resistant to water and chemicals and to wear and impact. Further, in addition to durability with respect to temperature, particles of water and air perform the function of a lubricant, so that a desirable boundary friction condition ca be easily maintained. Further, as a characteristic of plastics and the like, the materials themselves possess lubricating capability and the initial wear proceeds extremely slowly. Thus, there can be provided a plain pivot bearing for an ideal bobbin hanger, which maintains a stable frictional resistance moment even after 4–5 million revolutions, as is apparent from experimental values.

Further, in the present invention, the bar portion of said pivot has a diameter not exceeding about 3.8 mm particularly in the bearing portion, the front end bulge of said pivot has its upper surface formed to have a solid symmetrical shape such as sphere or cone, and the engageable portion of the bearing portion or case having close connection with the pivot bar portion and the front end bulge always maintains a sufficient clearance between it and the opposed surface of the bar portion of said pivot to establish a noncontact condition while the surface engageable with the front end bulge of said pivot is bowl-shaped so as to have perfect surface contact, said three being constructed to provide a free joint condition and a predetermined braking force. Thus, the construction of the bobbin hanger can be made extremely simple and compact. Further, the bobbin hanger is quickly responsive to a subtle movement of the roving being withdrawn from the package and the necessary braking force can be achieved smoothly, easily and stably without resorting to a separate braking mechanism as employed in the prior art. Further, the construction is simple and rugged, so that the manufacture is easy and economical.

BRIEF DESCRIPTION OF THE DRAWINGS

FIGS. 12 through 14*a*, *b* and *c* are views showing examples of the pivot bearing portion;

DESCRIPTION OF THE PREFERRED EMBODIMENTS

Figure 1:
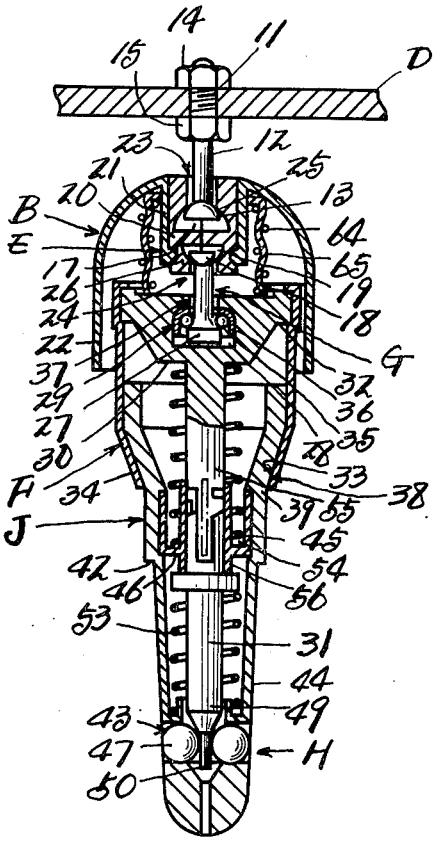
FIGS. 1 and 2 are front views, in longitudinal section, of a bobbin hanger forming the basis of U.S. Pat. No. 3,877,659, issued on Apr. 15, 1975, FIG. 1 showing a condition in which the bobbin has been taken off, FIG. 2 showing a condition in which a bobbin has been mounted.

In a preferred embodiment of a bobbin hanger as disclosed and claimed in U.S. Pat. No. 3,877,659, issued on Apr. 15, 1975, and owned by the assignee of the instant application, and shown in FIG. 1, a hanger rail D is provided with openings or rail slots 11 for suspending bobbin hangers B at predetermined intervals of space. The numeral 12 designates a bolt having a bulge 13 integral therewith having a spherical surface, said bolt being inserted at the upper end thereof into an opening 11 in the hanger rail D and fixed in position by nuts 14 and 15.

The bobbin hanger B comprises an upper member E suspended by the lower end of the bolt 12, an intermediate member G suspended by the lower end of said upper member E, and a lower member F suspended by the lower end of said intermediate memer G, said members E, F and G being rotatably and swingably suspended.

The upper member E consists of a cylindrical member 20 of two-split construction having a space portion 17 grasping the bulge 13 formed on the lower end of the bolt and a space portion 19 grasping a bulge 18 formed on the upper end of the intermediate member G, and a cylindrical holder member 21 for holding said cylindrical member 20 of two-split construction in its face-to-face assembled condition, said holder member 21 having a cover portion 22 integral therewith. Opening 23 and 24 in the cylindrical member 20 which open into the space portions 17 and 19, respectively, are larger in diameter than the corresponding shaft portions to be inserted therein. The peripheral edges of the openings 23 and 24 into the space portions 17 and 19 terminate in spherical surfaces 25 and 26, respectively. In the suspended condition, the spherical surfaces 25 and 26 and the spherical surfaces of the bulges 13 and 18 abut against each other to allow smooth rotation and swing therebetween.

In this connection, the upper member E may be rotatably and swingably suspended by fixedly securIng the lower end of the bolt to the top surface of the upper member, forming a spherical bulge on the upper end of the bolt and fitting said spherical bulge in an opening formed in the guide rail D. The intermediate member G is in the form of a bar-like member having bulges 18 and 27 at opposite ends thereof, the upper bulge 18 being fitted in the lower space portion 19 of the upper member E, the lower bulge 27 being fitted in the space portion 28 of the lower member F through bearing means 29. Thus, the lower member F is suspended by the bearing means 29 so that it can be smoothly rotated. Such portion may be of pivot bearing construction (not shown) by providing steel balls between the upper end bulge 18 and the periphery of the opening 24 in the lower space portion 19.

The lower member F consists of a base portion 30, suspended by said intermediate member G, a movable portion J suspended by said base portion 30 so as to be vertically movable with respect to said base portion, three locking members H received in the lower portion of said movable portion J in such a manner that they can be projected and retracted, and a spindle member 31 adapted to cause said three locking members H to be projected and retracted in unison in connection with the upward and downward movement of the movable portion J.

The base portion 30 consists of a top plate portion 32 having a space portion 28 in the upper central region thereof, and a cylindrical guide member 34 having a conical opening 33 in the lower region thereof, the upper end of said guide member being fixed to the outer periphery of the top plate portion. The bearing means 29 to be installed in the space portion 28 of the top plate portion 32 is composed of a plurality of steel balls 35 and a bowl-like member 36 providing a surface on which said steel balls run. The numeral 37 designates an opening for receiving the shaft portion of the intermediate member G, said opening being larger in diameter than said shaft portion. The bearing means 29 is disposed on the bulge 27 of the intermediate member G.

Figure 2:
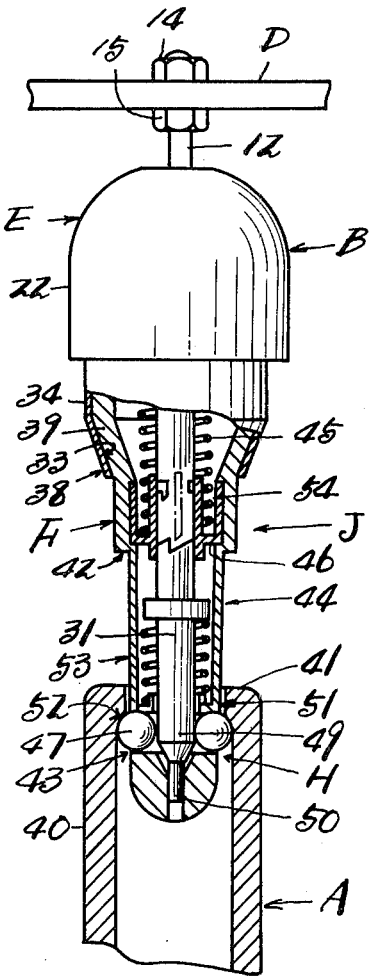
Figure 3:
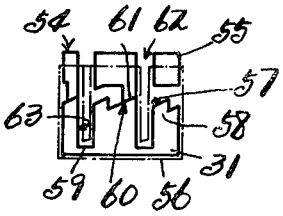
FIGS. 3 and 4 are explanatory views showing the function of a clutch mechanism corresponding to FIGS. 1 and 2, respectively, the views being in a developed form.
Figure 7:
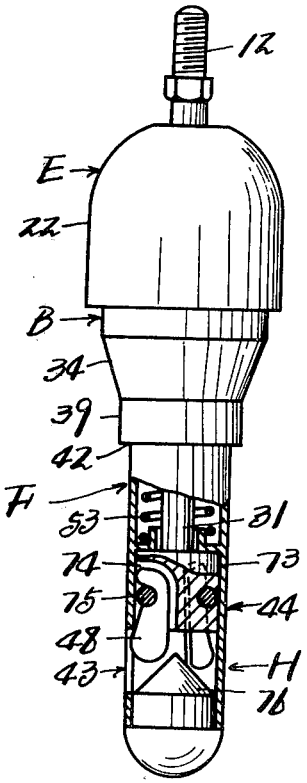
FIGS. 7 and 8 show modifications of the bobbin locking member, FIG. 7 showing a condition in which the bobbin has been taken off, FIG. 8 showing a condition in which a bobbin has been mounted.
Figure 8:
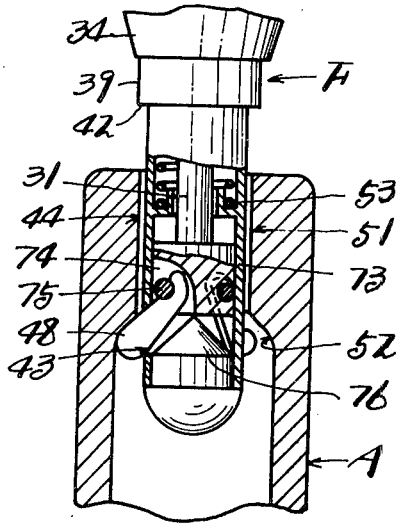

The movable portion J consists of a bobbin insert portion 44 which, in the upper region thereof, has an open portion 39 fitted in guide member 34 and having a conical surface 28 conforming to the conical opening 33 in the guide member 34, which, in the intermediate peripheral region thereof, has a step portion 42 against which the upper end shoulder 41 of a bobbin 40 will abut, and which has window portions 43 extending downwardly from said step portion 42 and located at places trisecting the peripheral surface near the lower end, the arrangement being such that the locking members H can be projected and retracted through said window portions 43. The numeral 45 designates a spring compressed and disposed on the top plate portion 32 and in the interior of the movable member J, the elastic force of said spring 45 serving to urge the conical surface 38 of the movable portion J into elastic abutment against the conical surface 33 of the guide member 34. The locking member H may be in the form of a spherical member as shown in FIGS. 1 and 2 or in the form of an arm member 48 having a curved surface at the front end thereof as shown in FIGS. 7 and 8. Further, it is preferable that a shperical member be rotatably mounted on the arm member 48 at the front end thereof.

The following description will be made with reference to the case where spherical members 47 are installed in the window portions 43, as shown in FIGS. 1 and 2.

The arbor 31 is inserted in the movable portion J and has at the front end region thereof a large diameter portion 49 adapted to project the spherical members 47 through the window portions 43 and a small diameter portion 50 adapted to retract the spherical members 47 into the window portions 43. Thus, the condition shown in FIG. 2 is such that the spherical members 47 are partly projected through the peripheral surface of the bobbin insert portion 44 to lock the inner shoulder 52 of the axial bore 51 of the bobbin 40. The diameter of the window portions 43 is such that the spherical members 47 are prevented from falling off therethrough. Further, the configuration of the window portions is such that when the small diameter portion 50 is positioned opposed to the window portions 43, the spherical members 47 in the window portions 43 roll by their own weights. The numeral 53 designates a spring which keeps the spindle member 31 in an upwardly urged condition.

The small and larger diameter portions 49 and 50 of the spindle member 31 alternately face the window portion 43 for each upward and downward movement of the movable portion J. A clutch mechanism 54 for upwardly and downwardly moving the spindle member 31 in connection with the upward and downward of the movable memer J as described above is as follows. The clutch mechanism 54 is composed of a shaft portion 55 fixed to the top plate portion 32, a cylindrical portion 56 fixed inside the movable portion J and a spindle member 31.

On the peripheral surface of the upper end of the spindle member 31 and at places quadrisecting the circumference, there are formed saw-tooth-like teeth 58 each having an inclined surface 57, said surfaces 57 being inclined in the same direction. Of four valleys defined by said four teeth, two opposed ones are formed with grooves 59 which extend vertically downward.

The shaft portion 55 opposed to the spindle member 31 is provided with teeth 61 on the peripheral surface of the lower end thereof and at places bisecting the circumference, each of said teeth having an inclined surface 60 On the lateral surface thereof. Such inclined surface 60 is provided with a vertically upwardly extending groove 62 in the intermediate region thereof.

It is so arranged that when said grooves 59 and 62 are vertically aligned with each other, the inclined surfaces 57 and 60 of the opposed teeth 58 and 61 overlap each other with some clearance therebetween adjacent the tops thereof.

The cylindrical portion 56 is provided with vertically extending ridges 63 at two places on the inner surface, said ridges being adapted to engage the grooves 59 in the peripheral surface of the spindle member 31 and the grooves 62 in the peripheral surface of the shaft portion 55. Engagement between the grooves 62 and the ridges 63 enables the cylindrical portion to move axially with respect to the shaft portion 55, while engagement between the grooves 59 and the ridges 63 enables the spindle member 31 to move with respect to the cylindrical portion 56. In addition, the ridges 63 are permanently engaged with the grooves 62.

Figure 4:
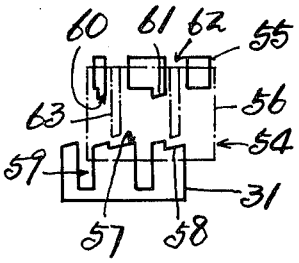

The condition shown in FIG. 2 is such that the ridges 63 on the cylindrical portion 56 abut against the valleys of the spindle member 31 as shown in FIG. 4, while the condition shown in FIG. 1 is such that the ridges 63 on the cylindrical portion 56 are aligned with and fitted in the grooves 59 in the spindle member 31.

In the condition shown in FIG. 2, if the bobbin 40 is upwardly thrusted so that its upper end shoulder 41 upwardly thrusts the stop portion 42 of the movable portion J, then the movable portion J is upwardly moved within the guide member 34 while compressing the spring 45. Along with this movement of the movable portion J, the cylindrical portion 56 is also moved along the shaft portion 55. When the cylindrical portion 56 is upwardly moved, the spindle member 31 elastically urged against the lower ends of the ridges 63 on the cylindrical portion 56 by the spring 53 is also moved. That is, the relative position between the window portions 43 and the spindle 31 will not change until the teeth 58 on the front end surface of the spindle member 31 abut against the teeth 61 on the lower end surface of the shaft portion 55. When the inclined surfaces 57 and 60 Of the teeth 58 and 61 abut against each other, the upward movement of the spindle member 31 is stopped by the shaft portion 55 and when the ridges 63 are disengaged from the valleys, the inclined surfaces 57 of the teeth 58 of the spindle member 31 are rotated along the inclined surface 60 of the teeth 61 of the shaft portion 55 until the grooves 59 in the spindle member 31 and the grooves 62 in the shaft member 55 are vertically aligned with each other. In this condition, if the movable portion J is relieved of the upward thrust, the elastic force stored in the spring 45 pushes down the movable portion J so that the cylindrical portion 55 is lowered along with the movable portion J and the ridges 63 are slid into the grooves 59, while the position of the spindle member 31 is maintained unchanged regardless of the downward movement of the movable portion J and cylindrical portion 56. That is, the net result is that the spindle member 31 has been moved upwardly relative to the movable portion J and that the small diameter portion 50 has been positioned opposed to the window portions 43. Therefore, the spherical members 47 are inwardly rolled in unison until they abut against the small diameter portion 50, with the result that the spherical members 47 are retracted into the movable portion J, as shown in FIG. 1, thus allowing extraction of the bobbin 40.

In connection with the next bobbin inserting action, the spindle member 31 is downwardly moved with respect to the movable portion J and the large diameter portion 49 causes the spherical member 47 to be projected in unison through the window portions 43 to lock the bobbin in position. During the downward movement of the movable portion J, the centering between the guide portion 34 and movable portion J is automatically effected by virtue of their conical surfaces.

Installed between the upper and lower members E and F to surround the intermediate member G is an annular member I which serves to seal the connection, particularly the bearing means 29. As shown in FIGS 1 and 2, the annular member I is in the form of a coiled spring 64 around which a soft material 65 such as a film sheet is stretched. The upper and lower ends of the annular member slidably abut against the opposed surfaces of the upper and lower members E and F. By setting the elastic force of the spring of the annular member I at a suitable value, the excessive rotation of the lower member F can be suppressed.

Figure 5:
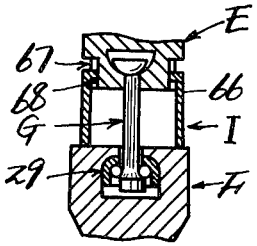
FIGS. 5 and 6 show modifications of the annular member for sealing a bearing portion.

Such annular member may be in the form of a simple cylindrical member 66 as shown in FIG. 5. In such arrangement, the cylindrical member 66 is placed on the top surface of the lower member F, and the upper edge of the cylindrical member 66 is provided with lugs 67 each adapted to be engaged inja recess 68 cut in the outer periphery of the upper member E. Thus, the cylindrical member 66 can be upwardly and downwardly moved along the outer periphery of the upper member E regardless of the rotation of the upper and lower members E and F. By suitably selecting the mass of the cylindrical member 66, it is possible to suppress the excessive rotation of the lower member F by the weight of said cylindrical member.

Figure 6:
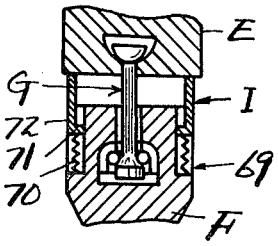

FIG. 6 shows another modification of the annular member I, wherein the upper outer periphery of the lower member F is provided with an annular step portion 69 on which an annular member 72 having a flange 71 around the lower edge thereof is placed with a spring 70 interposed therebetween to elastically urge the upper edge of the annular member 72 against the lower surface of the upper member E, achieving the same function and effect as the annular member described above.

In FIGS. 8 and 7, the arm members 48 are mounted in grooves 74 located at places trisecting the peripheral surface of the large diameter portion 73 at the lower end of the spindle member 31, the base portions of said arm members being locked by a ring 75. Fixedly secured to the lower end of the bobbin insert portion 44 is an upwardly directed conical member 76 adapted to unfold said arm members 48. Thus, the downward movement of the spindle member 31 causes the three arm members 48 to be unfolded and projected through the window portions 44 until they lock the bobbin 40, as shown in FIG. 8. The upward movement of the spindle member 31 causes the unfolded arm members 48 to be retracted as they are pushed up by the spring 45, as shown in FIG. 7.

Figure 9:
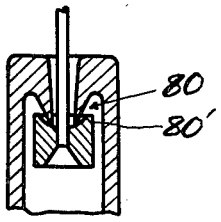
FIGS. 9 and 10 are views showing plain bearing type pivot bearing portions according to the present invention.
Figure 10:
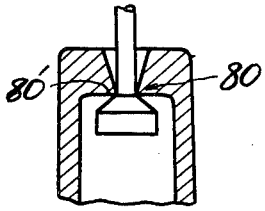
Figure 11:
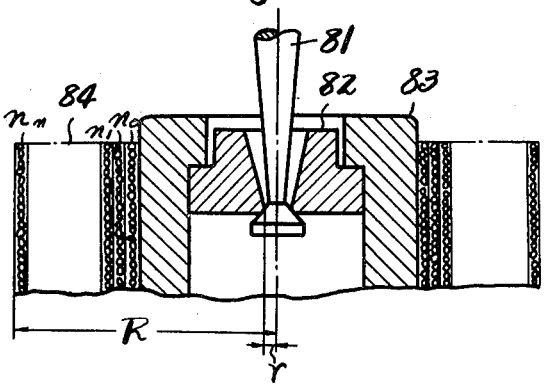
FIG. 11 is a view showing the details of a pivot bearing portion.

FIGS. 9 and 10 show the use of a plain bearing in place of a ball bearing so that the thrust bearing portion 80 of a bobbin hanger is made in the form of a pivot to utilize the resulting edge contact surface 80' in the contact region for obtaining a predetermined braking force. This will now be described in more detail with reference to FIG. 11. The thrust bearing portion 80 consists of a pivot 81, a bearing member (or inner member) 82 and a case (or outer member) 83 for receiving said bearing member. In addition, 84 designates a winding of roving on the outer member 83, which is considered to be a bobbin, the characters $N_o$, $N_1 \ldots N_n$ designating layers.

As is clear from Coulomb's law, the force of sliding friction is proportional to the total normal force acting on the contact surface between solids and is independent of the total apparent contact area and of the sliding speed. That is, by Coulomb's law, the equation $F = W \tan \theta$ ($\tan \theta$ : coefficient of friction, F: frictional force, W: normal force acting on frictional surface) holds. On the other hand, as to the frictional resistance moment, the equation $M = P\ d/2.\mu$ ($\mu$: coefficient of friction, d: shaft diameter, P: total pressure on frictional surface, M: frictional resistance moment) holds. Applying the two equations to the relation involved in unwinding the package, the equation $T = r\ K$ (T: force required for withdrawing the roving, R: diameter as measured from the axis to the outermost peripheral layer, *r:* pitch circle diameter, $K = p/r$ ) approximately holds. Therefore, according to the above equation, if the appropriate values in withdrawing the roving from the package are determined, the pitch circle diameter *r* in this plain bearing will be self-determined. It has been established by experience that ordinarily, the value of roving withdrawing force T is suitably within the range of 3-10 gr, while it has been experimentarily verified that the roving withdrawing force T can be well maintained within this range, which means that the braking according to this principle is useful. Thus, the present invention is the result of a study of the characteristics of the bearing function required for a bobbin hanger, on the basis of the above theorey. Therefore, it is different in principle from the commercially available bobbin hanger constituted by a ball bearing and a brake.

Figure 12:
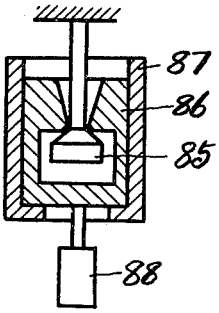
Figure 13:
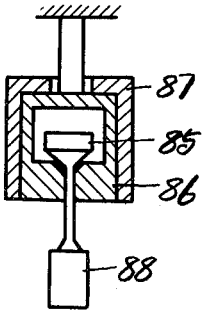
Figure 14:
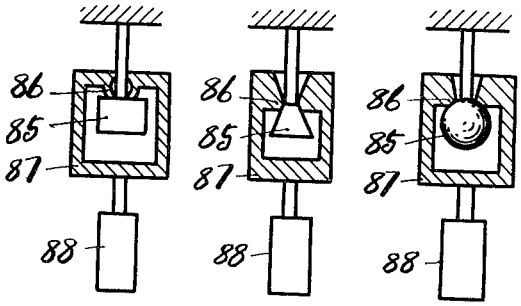

As shown in FIGS. 12 through 14, the thrust bearing portion described above consists of a pivot (or core) 85, a bearing members (or inner body) 86 and a case (or outer body) 87 for receiving said bearing member, and a bobbin is suspended therefrom. The type shown in FIG. 12 is such that the pivot 85 is fixed while the bearing member 86 is rotatable. The type shown in FIG. 13 is such that the bearing member 86 is fixed while the pivot 85 Is rotatable. The term "fixed" used herein, however, refers to exclusion of rotation but includes the case of having a free joint effect such as an oscillating action. Ordinarily, the pivot 85 is barrel-shaped but exceptionally, it may be conical as shown in FIGS. 12 and 13. As for production, there are two methods, namely, cutting and molding. In order to advantageously embody the present invention, the molding process is more useful, the reason for which will be later described. With this pivot 85 as a core body, the bearing construction is constituted by the three members, namely, the core body 85, inner body 86 and outer body 87. Of these bodies, the bearing member 86, which is the inner body, is split-molded and encloses the core body 85 to establish the bearing condition for the pivot and is then enclosed in the outer body 87 in a hoop fashion. As a result, there is provided a perfectly unitized plain pivot bearing.

Figure 15:
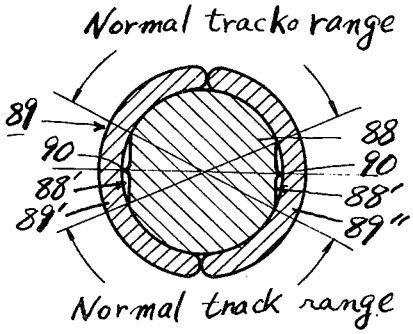
FIG. 15 is a sectional view showing the relation between the pivot and the bearing member.

As shown in FIG. 15, the plain pivot bearing construction described above is based on the relation between the pivot 88 and the bearing member 89. The pivot 88 is produced either by cutting or by molding. Molding method includes various processes, for example, plastics molding, diecasting, powder molding, header process and rolling. The method by cutting is the most common method but when mass-production of this kind of pivots is investigated this method, including rolling process, can hardly be said to be the most suitable method, even in the case of using an automatic machine. It has been verified that the molding method is optimum as considered from the standpoint of configurations and number. However, as a drawback involved in processing by the molding method, the problem of a casting fin being formed on the split mold abutting surface has to be solved before the molding method can be put into practice. This problem has been solved in a simple manner so that even if fine casting fins are produced this does not at all influence the plain bearing performance. In principle, this method comprises cutting the periphery of the mold abutting surface portion of the pivot 88 to provide flat surfaces 88' thereby to separate the cut surface to the extent that the fins produced will not touch the inner contact surface of the bearing member. In FIG. 15, the split-formed bearing members 89' and 89'' surrounding the central pivot 88 are adapted to slide in contact, the two maintaining a relation in which they will be quietly rotated in suspended condition along a track concentric with the pitch circle. In this case, the relation of the sliding contact surface is such that so long as the bearing members 89' and 89'' keep contact over the normal track range, there will be no action whatever which detracts from the performance of the bearing. Moreover, it is clear that as a characteristic of a plain pivot bearing, the contact surface of the bearing members 89' and 89'' performs the function and sliding can take place independently of the flat surfaces 88' of the pivot 88. In addition, 90 designates casting fins.

It is usual with the conventional bobbin hangers to use a ball bearing in any rotatable portion and a plain bearing which does not use any metal has not been put into practical use. Needless to say, this portion is the important portion which has a hold upon the bobbin hanger. Accordingly, the idea of a plain bearing could not be conceived from the concept of additionally using the conventional brake. There is the user's need that the bobbin hanger be capable of maintaining its subtle function for more than 10 years without maintenance under the severe condition which strictly prohibits the use of lubricants. The selection of a material for this purpose cannot be achieved simply by a combination of experience and learning. That is, the achievement is the result of experiments involving trial and error. Thus, the materials which can be used in the present invention must be such that they can retain a highly stabilized low frictional force without using lubricants. Experiments have shown that the use of a metallic material in a bearing under non-lubricating conditions entails fatal latent troubles (for example, a marked trouble caused by abraded powder). The conclusion has been reached that the use of metals in the bearing portion of a bobbin hanger cannot possibly be allowed. Thus, long-term life tests of such materials in combination as stainless steel SUS 27, hard chrome plated steel, nitrided steel and resin materials were conducted and the continuous production of abraded metal powder was observed from the start of use and, moreover, smooth rotation was not ensured. This has been proved by experience to be identical with the ill-defined troublesome phenomenon which has been frequently observed in the conventional ball bearings. Thus, the cause of such trouble has been cleared up. Concurrenly with the above tests, various tests were repeatedly conducted using combinations of resin type materials in plain bearings and it has been found that in combinations of such plastics materials as Delrin, nylon 66, Teflon and GL with porcelain type and titanium type materials, those plastics materials which have coeffieients of friction of about 0.15 to 0.3 (these values are obtained when V = 20 cm/sec or thereabouts; in the case of a bobbin hanger, V is 1/20 to 1/30 of the first-mentioned V and it has been experimentarily verified that the actual in this case is decreased to 1/2 of the mentioned values) maintain extremely stabilized characteristics. Further, when these combinations are used, the pivot diameter can be set at 2.5–3.5 mm and it has been ascertained that the degree of safety for tensile strength is satisfactory, amounting to 20 times. It has also been experimentarily ascertained that the withdrawing tension in the roving in this case is thoroughly stabilized within the range 4–8 gr. The use of metal in the bearing portion not only raises a problem of rust but also cooperates with complicated factors including the fly waste, dirt and dust, dewdrops and abraded powder to interfere with smooth rotation of the bearing portion, causing a rapid change in the torque in the bobbin hanger, which accounts for the cause of the trouble. It is, therefore, preferable that this portion be made in a plain form and that plastics, porcelain type or titanium type materials be used.

In the above construction, the bar portion, especially the bearing portion of the pivot is a slender suspension support having a diameter *d* of about 3.8 mm or less. Further, it is desirable that the upper surface of the front end bulge of the pivot be spherical or inclinedly shaped, for example, conical. This is because it is essential that the arrangement of the bearing portion contact surface of the pivot be such that the lower detachable structure (rotor) always maintain a centripetal action and that the bearing contact surface be in correct complete-surface contact.

In the present invention, since the upper portion of the pivot is made spherical to provide a fully self-centripetal construction, theoretically the above-mentioned condition is not requied. What is essential is that the shape of the upper surface of the front bulge of the pivot be perfectly symmetrical with respect to the axis thereof.

Figure 16:
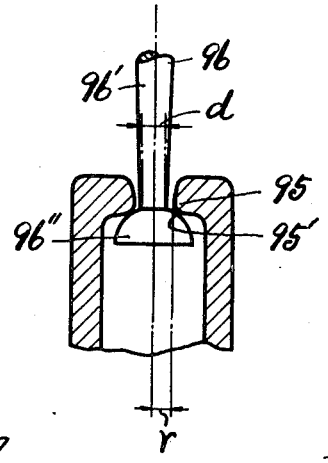
FIGS. 16 through 18 are views showing other modifications of a principal portion of the present invention, i.e., plain bearing type plain pivot bearing portion.
Figure 17:
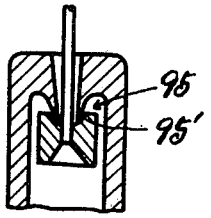
Figure 18:
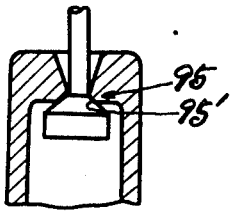
Figure 19:
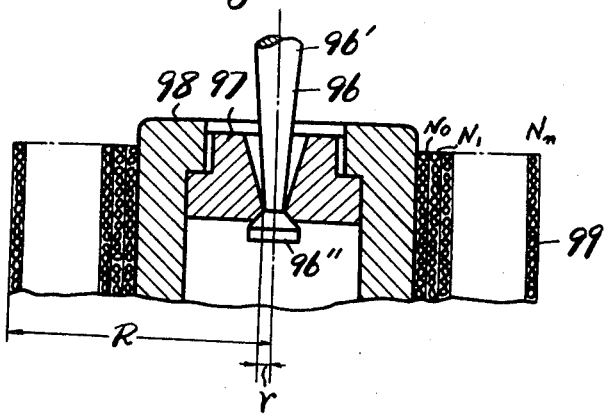
FIG. 19 is an enlarged partial view for explaining in the concrete said plain pivot bearing portion.
Figure 20:
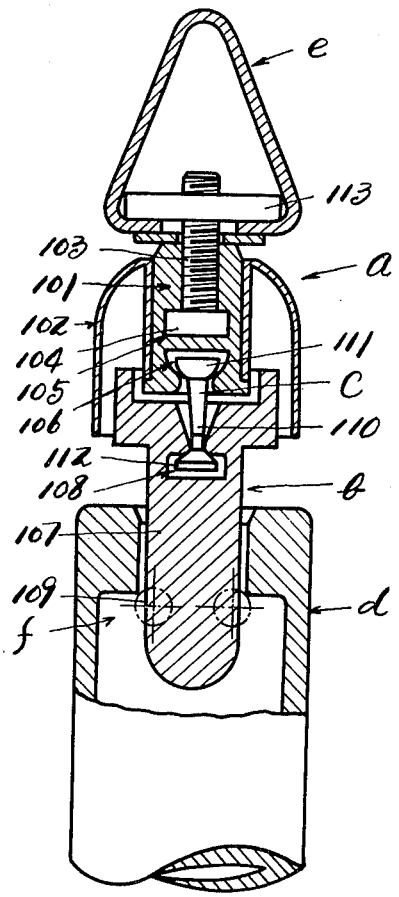
FIG. 20 is an entire assembled sectional view showing sectional view showing the representative embodiment (or all-inclusive embodiment)

This is because if the above-mentioned condition is met, it is possible to sharply respond by subtle movements during use. This is also because by giving an inclined shape to the front and bulge of the pivot, it is possible to make smooth the braking action performed by the contact surface 95 with the bearing member or the case. Therefore, the selection of the radius *r* shown in FIGS. 16 and 19 has close connection with the required torque resistance value and plays a very importnat role. Further, the area of the bearing member 97 or case 98 opposed to the pivot bar portion 96' is important for enabling the structure assembled of the three to act in a universal joint condition, and it is important to form a bowl-shaped opening which is somewhat wider than the bar portion 96', thereby maintaining some clearance between the opening and pivot bar portion. Thus, the design should be such as to avoid contact with the front end bulge 98'' of the pivot.

The upper member *a* of the bobbin hanger consists of a main body 101 of synthetic resin having a cylindrical outer periphery, and a case 102 of synthetic resin fitted over said main body. In addition, the main body 101 is internally provided with a space 105 for receiving the lower bulge 104 of a bolt 103 and a space 106 for receiving the upper bulge of an intermediate member to be later described.

The lower member *b* consists of a base portion (main body) 107 having a space 108 for receiving the lower bulge of the intermediate member, and balls 109 which are arranged in the lower portion of the main body so that they can be horizontally and radially thrown out.

The intermediate member *c* is disposed between said upper and lower members *a* and *b* and consists of a bar-like main body 110 centripetally and brakably disposed between said two members and having bulges 111 and 112 at both ends thereof. It is preferable from tha standpoint of strength that the diameter of the lower neck portion be about 3.8 mm or less and that the diameter of the upper neck be equal to or slightly larger than that. The surfaces of the bulges 111 and 112 which engage the spaces 106 and 108 in the contact regions thereof are spherical.

When the three members *a*, *b* and *c* are assembled together, the upper portion constitutes a self-centripetal suspension mechanism while the lower portion constitutes a self-alogning suspension mechanism. Therefore, the inner shoulder of the top bore in a bobbin *d* is engaged with and gripped by the engageable members *f* in the form of balls 109 which are free to rotate and capable of being horizontally and radially thrown out. When the upper portion is fitted at its nut portion 113 of the bolt 103 in the groove in a hanger rail *e* and fixedly gripped in position, there can be obtained a perfect and ideal self-aligning universal joint type centripetal action and braking force.

Figure 21:
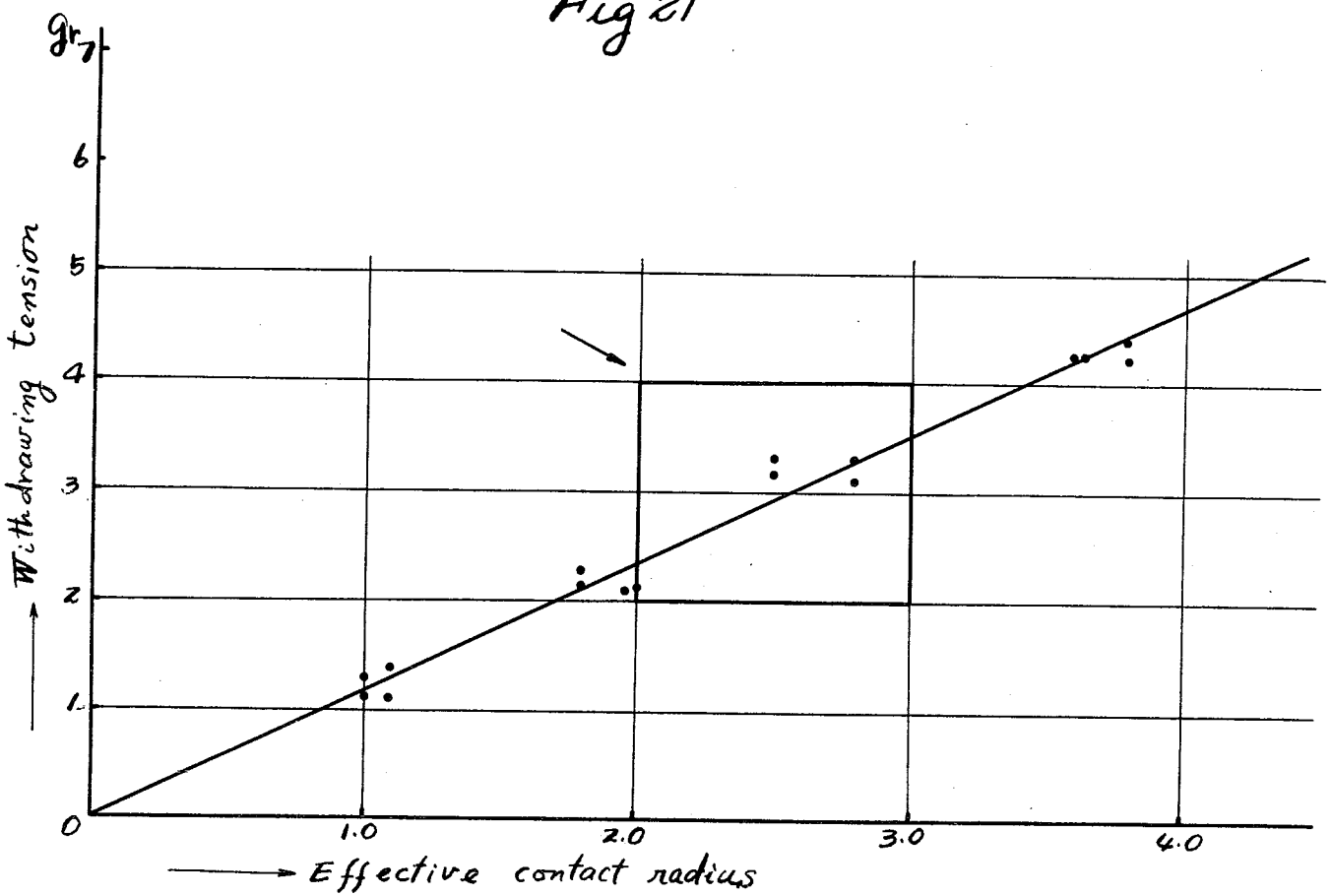
FIG. 21 shows experimental data showing the relation between the withdrawing tension in the roving and the effective contact radius of a centripetal member, which is a principal portion of the present invention, constituting a plain bearing portion.

FIG. 21 shows corroborative data, illustrating the relation between the bearing bore sliding contact diameter and the withdrawing tension. As is clear from the figure, when the effective contact radius is in the range from 2 mm to 3 mm, the roving withdrawing tension is in the range from 29 gr to 49 gr, which is the optimum desired range in the actual operation. In addition, the graph shows that if the effective contact radius exceeds 5 mm, the withdrawing tension enters the dangerous range.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. A bobbin hanger for mounting on a hanger rail comprising an elongated main body member having a top centrally disposed cavity area and a bottom disposed cavity area at the respective ends thereof, attaching means fixedly secured to and within the top cavity area of said body member and constituting the means for attaching the bobbin hanger to a hanger rail, the bottom cavity area having a spherical surface at its lower end thereof, an intermediate member having an elongated bar-like central body portion, an enlarged top head portion, and an enlarged bottom head portion at each end of the body portion respectively, said top head portion being seated in said bottom cavity area of said main body member and being semi-circular in configuration with the bottom surface thereof being spherical and corresponding to the spherical surface of said bottom cavity area, and a bottom member having an enlarged upper portion with a recess area of a dimension greater than the diameter of said main body member for receiving the bottom end of said main body therein and an internal cavity area extending centrally downwardly from said recess area, the bottom of said internal cavity area being enlarged to receive the enlarged bottom head portion of said intermediate member therein to connect said bottom member to said intermediate member, said bottom member further having a bottom tubular portion having a diameter sufficient to permit same to pass through the central aperture of a bobbin, said bottom portion also including means adjacent its lower end to releasably engage a bobbin when the portion is inserted in the central aperture of a bobbin.

2. A bobbin hanger in accordance with claim 1, wherein said main body member consists of a cylindrical member composed of two split mating components with each split component having mating areas defining the upper and lower cavity area of the main body member and cover means for retaining said mating components in light engagement.

3. A bobbin hanger in accordance with claim 1, wherein a pivot-like thrust bearing is positioned at the connecting region between the intermediate and bottom members, the edge contact surface of said thrust bearing providing a predetermined braking force.

4. A bobbin hanger in accordance with claim 1, wherein said means releasably engaging a bobbin adjacent the lower bottom portion of the bottom member are spherical members disposed at locations trisecting the peripheral surface of the bobbin receiving portion so that said spherical members can be projected and retracted and rotated.

5. A bobbin hanger in accordance with claim 1, wherein the connecting portion between the intermediate member and the bottom member is made in the form of a plain bearing.

* * * * *